US007341252B2

(12) United States Patent
Jacklin et al.

(10) Patent No.: US 7,341,252 B2
(45) Date of Patent: Mar. 11, 2008

(54) BOARD GAME

(76) Inventors: Shawn Jacklin, Box 177, Bazanson, Alberta (CA) T0H 0G0; Brent Froh, 882, Site 2, Comp. 11, Fort St. John, British Columbia (CA) V1J 4M7

( * ) Notice: Subject to any disclaimer, the term of this patent is extended or adjusted under 35 U.S.C. 154(b) by 0 days.

(21) Appl. No.: 11/144,674

(22) Filed: Jun. 6, 2005

(65) Prior Publication Data

US 2006/0273514 A1 Dec. 7, 2006

(51) Int. Cl.
*A63F 3/00* (2006.01)

(52) U.S. Cl. ..... 273/242; 273/285

(58) Field of Classification Search ..... 273/242, 273/243, 287, 236, 285
See application file for complete search history.

(56) References Cited

U.S. PATENT DOCUMENTS 1,201,100 A 10/1916 Rice-Wray
1,320,817 A 11/1919 Yost
2,026,082 A 12/1935 Darrow
3,778,063 A 12/1973 Strand
3,952,423 A 4/1976 Gentry
3,989,253 A 11/1976 Schifman
4,003,577 A * 1/1977 Bolach ..... 273/243
4,303,246 A 12/1981 Strongin
4,378,941 A * 4/1983 Derby ..... 273/273
4,440,395 A 4/1984 Hyland et al.
4,468,036 A * 8/1984 Istrati et al. ..... 273/271
4,550,916 A 11/1985 Ortiz
4,790,540 A * 12/1988 Lim et al. ..... 273/309
5,836,585 A * 11/1998 LaCivita ..... 273/287
6,142,473 A * 11/2000 Bryant ..... 273/244
6,854,730 B2 2/2005 Braun

* cited by examiner

*Primary Examiner*—Vishu K. Mendiratta
(74) *Attorney, Agent, or Firm*—Suzannah K. Sundby, Esq.; Smith, Gambrell & Russell, LLP

(57) ABSTRACT

A game board comprising: an upper surface member, preferably composed of a transparent material; a peripheral edge connected to the upper surface member; and at least one aperture in the peripheral edge for receiving a game piece, the game piece preferably an elongate tile provided with indicia relevant to game play. A method of playing a game using the game board is also taught, the method comprising the steps of: a. placing player tokens at a selected location on surface indicia on the upper surface member; b. allowing the players to alternate rolling a die to determine an amount of movement for each of the player tokens across the upper surface member, c. moving each of the player tokens by thusly determined amounts of movement; d. when moving one of the player tokens to a space above an aperture, observing indica within the aperture through the transparent upper surface member, the aperture indicia providing game instruction; e. responding to the game instruction provided by the aperture indicia; and f. in the event that the aperture is empty, allowing the player to insert a tile into the aperture, covering the aperture indicia and allowing observation of tile indicia through the transparent upper surface member, which tile indicia provides game instruction.

1 Claim, 8 Drawing Sheets

BOARD GAME

FIELD OF THE INVENTION

This invention relates to board games for amusement and entertainment, and more particularly to board games that comprise moveable pieces.

BACKGROUND OF THE INVENTION

Board games have been a popular form of entertainment for many years, including game concepts where moveable pieces are employed. There are many relatively simple forms of such board games, including well-known games such as checkers or dominoes, which essentially comprise only a specified number of game pieces and a set of rules for determining game piece movement on or across a game board.

While these more simple games are diverting and entertaining, and may be quite challenging in the hands of more advanced players, numerous game concepts have been subsequently developed embodying increasing complexity, resulting in enhanced enjoyment and interest for players. For example, games such as Life™ and Monopoly™ are well-known versions of these more complex game concepts wherein additional game components are introduced to enhance game play, such as individual player tokens, dice for determining movement of player tokens, game cards providing instructions during game play, game currency, and other game pieces (such as the "hotels" of Monopoly™). In addition, these more complex game concepts can present interesting thematic aspects, such as the real estate transactions of Monopoly™.

While increased complexity and additional game components can enhance the entertainment value for players and encourage skills development, and such new developments would therefore be desirable, conceptual developments embodying heightened complexity can limit the potential uses of a novel board or board accessory to a particular game concept.

SUMMARY OF THE INVENTION

The present invention provides a novel and inventive game board that can be utilized with a variety of game concepts.

According to a first aspect of the present invention there is provided a game board comprising: an upper surface member; a peripheral edge connected to the upper surface member; and at least one aperture in the peripheral edge for receiving a game piece.

According to a second aspect of the present invention there is provided a board game comprising: a game board comprising: an upper surface member, a peripheral edge connected to the upper surface member; and at least one aperture in the peripheral edge for receiving a game piece; and at least one game piece for selective insertion within the at least one aperture.

According to a third aspect of the present invention there is provided a method of playing a board game, for at least two players, the board game comprising: a generally transparent upper surface member, provided with surface indicia relevant to game play, the surface indicia including spaces for placement of player tokens; a peripheral edge connected to the upper surface member; at least one aperture in the peripheral edge for receiving a tile member, the at least one aperture disposed beneath the spaces for placement of player tokens, the at least one aperture including a lower surface provided with aperture indicia relevant to game play and open to the upper surface member to enable observation of the aperture indicia; at least one tile member for selective insertion within the at least one aperture, the at least one tile member provided with tile indicia relevant to game play; at least two player tokens for movement across the upper surface member; and at least one die for determining an amount of movement for each of the at least two player tokens across the upper surface member; the method comprising the steps of: a. placing the at least two player tokens at a selected location on the surface indicia; b. allowing the at least two players to alternate rolling the at least one die to determine the amount of movement for each of the at least two player tokens across the upper surface member; c. moving each of the at least two player tokens by thusly determined amounts of movement; d. when moving one of the at least two player tokens to a space above an aperture, observing the aperture indicia, the aperture indicia providing game instruction; e. responding to the game instruction provided by the aperture indicia; and f. in the event that the aperture is empty, allowing the player to insert a tile member into the aperture, covering the aperture indicia and allowing observation of the tile indicia, which tile indicia provides game instruction.

In exemplary embodiments of the present invention, the upper surface member is composed of a generally transparent material, with the peripheral edge generally perpendicular to the upper surface member. The at least one aperture is preferably defined by the upper surface member and an opening in the peripheral edge; more preferably, the opening comprises a channel, the channel being open at both an outer portion adjacent the peripheral edge and an upper portion adjacent the upper surface member; and most preferably, the channel comprises a lower surface, an inner end surface spaced from the peripheral edge, and opposed side surfaces, defining the outer portion and the upper portion, the upper surface member transparency then allowing observation of the lower surface.

The game piece is preferably an elongate tile member sized to be slidably and removably receivable within the at least one aperture, provided with means for enabling extraction of the game piece from the at least one aperture (which extraction means are preferably an outwardly projecting portion of the game piece itself, extending outwardly from the at least one aperture and, most preferably, comprising ridges on the outwardly projecting portion to enable gripping of the game piece by a player).

The game board preferably comprises a plurality of apertures, adjacent apertures being separated by dividing means, the dividing means most preferably being a wall between adjacent apertures. The upper surface member, game pieces, and aperture lower surfaces are each preferably provided with game indicia relevant to game play (e.g. instructions on what course of action the player must next take, having landed on a space displaying such indicia). The game board itself is preferably foldable, comprising at least two parts connected at a connection region, the connection region comprising hinge means to enable folding of one of the at least two parts relative to the other, most preferably, the game board will comprise two generally equally sized parts, the connection region generally at a centre line of the game board when unfolded, the hinge means disposed at the centre line to allow the game board to be folded in half.

The board game also preferably comprises at least two player tokens for movement across the upper surface member; at least one die for determining an amount of movement for each of the at least two player tokens across the upper surface member; a plurality of game cards for providing instructions during game play; and game currency for use during game play. Such elements are commonly used in board games, and their utility is widely known and understood by those skilled in the art.

A board game according to the present invention, therefore, not only offers new features not found in the prior art, but also manifests numerous advantages over the prior art, including the presence of indicia on each tile to add functionality and enhance enjoyment by the players, and the adaptability of the game board itself to diverse game themes/concepts.

A detailed description of an exemplary embodiment of the present invention is given in the following. It is to be understood, however, that the invention is not to be construed as limited to this embodiment.

BRIEF DESCRIPTION OF THE DRAWINGS

In the accompanying drawings, which illustrate an exemplary embodiment of the present invention.

DETAILED DESCRIPTION OF A PREFERRED EMBODIMENT

Referring now in detail to the accompanying drawings, there is illustrated an exemplary embodiment of a game board according to the present invention generally referred to by the numeral 10. The game board 10 is generally in the form of a square when fully assembled and unfolded, 24.475 inches on each side, and 0.45 inches thick. The game board 10 comprises an upper surface member 12, which in this embodiment is a thin sheet (composed of two equally sized halves, as can be seen in FIGS. 1 and 4) of rigid, transparent plastic approximately 0.063 inches thick.

Figure 1:
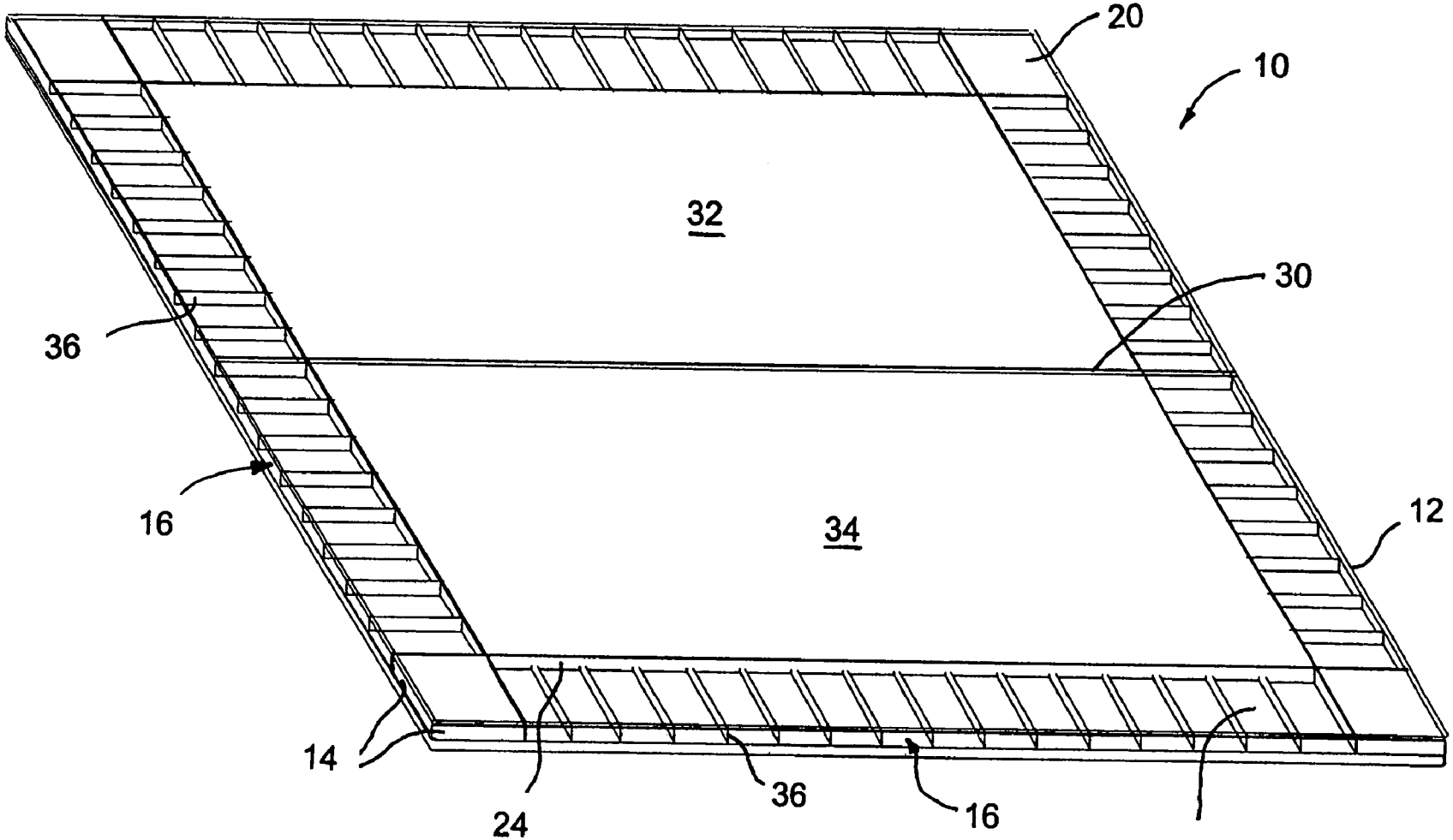
FIG. 1 is a perspective view of a game board according to the present invention.
Figure 2:
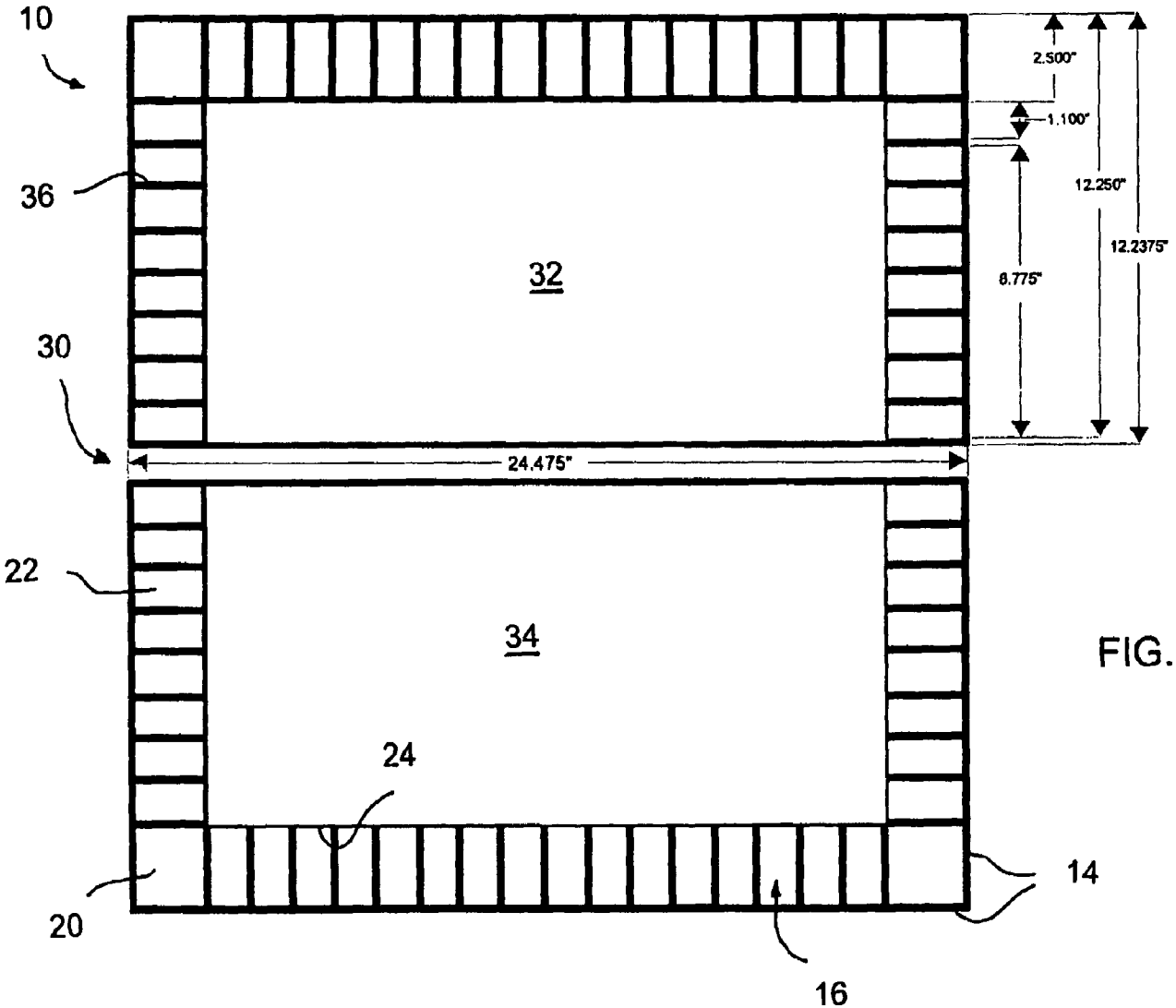
FIG. 2 is a top plan view of a game board according to the present invention, demonstrating placement of the apertures about the periphery of the game board.
Figure 4:
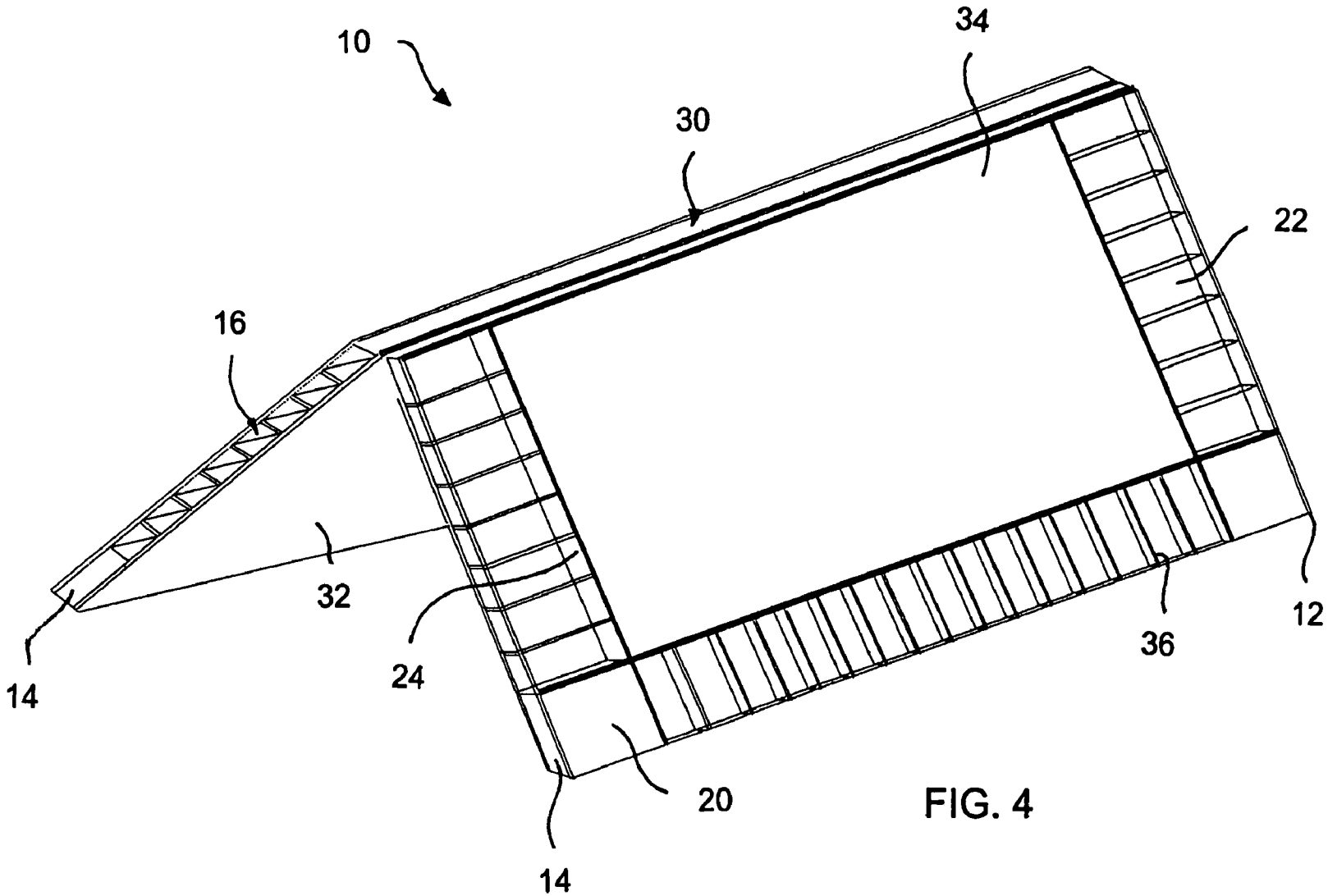
FIG. 4 is a perspective view of a game board being folded in half.

As can be seen in FIGS. 1, 2 and 4, the game board 10 is formed of two equally sized halves, a first part 32 and a second part 34. The first and second parts 32, 34 are connected at a connection region 30, which connection region 30 comprises hinge means (not shown) to enable folding of the game board 10 in half. Various forms of hinge means are known in the art, including a foldable strip of material affixed to the bottom of folding members adjacent the hinge area, and one skilled in the art would be able to determine appropriate and alternative forms of such hinge means.

Figure 3:
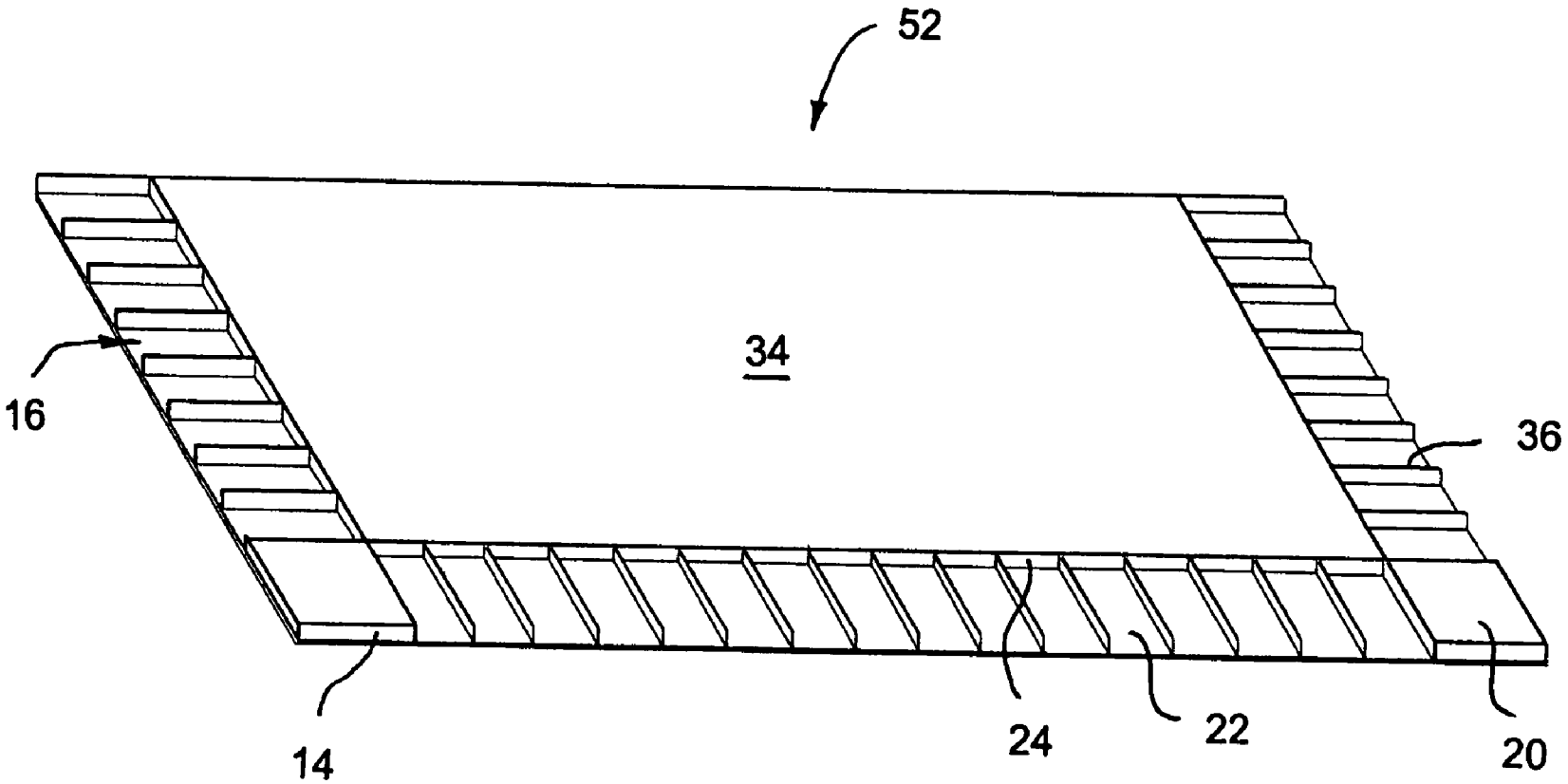
FIG. 3 is a perspective view of one half of a game board, with the transparent upper surface member removed, where the game board is composed of two parts foldable in half.

The game board also comprises peripheral edges 14, which in this embodiment are disposed generally perpendicular to the upper surface member 12. Although such peripheral edges 14 could depend from the periphery of the upper surface member 12 itself, in this preferred embodiment the peripheral edges 14 are part of a base member 52, as illustrated in FIG. 3, providing enhanced strength and stability to the game board 10. FIG. 3 illustrates only one base member 52, the lower section of an assembled second part 34 of the game board 10, and there would be a corresponding base member 52 that would be the lower section of an assembled first part 32 of the game board 10. An upper surface member 12 would be affixed to each base member 52 to form each of the first and second parts 32, 34. Although only the upper surface member 12 is composed of transparent plastic in this embodiment, it is possible to also manufacture the base member 52 from transparent plastic, enabling each side of the game board 10 to present a different game concept (as discussed below).

Figure 5:
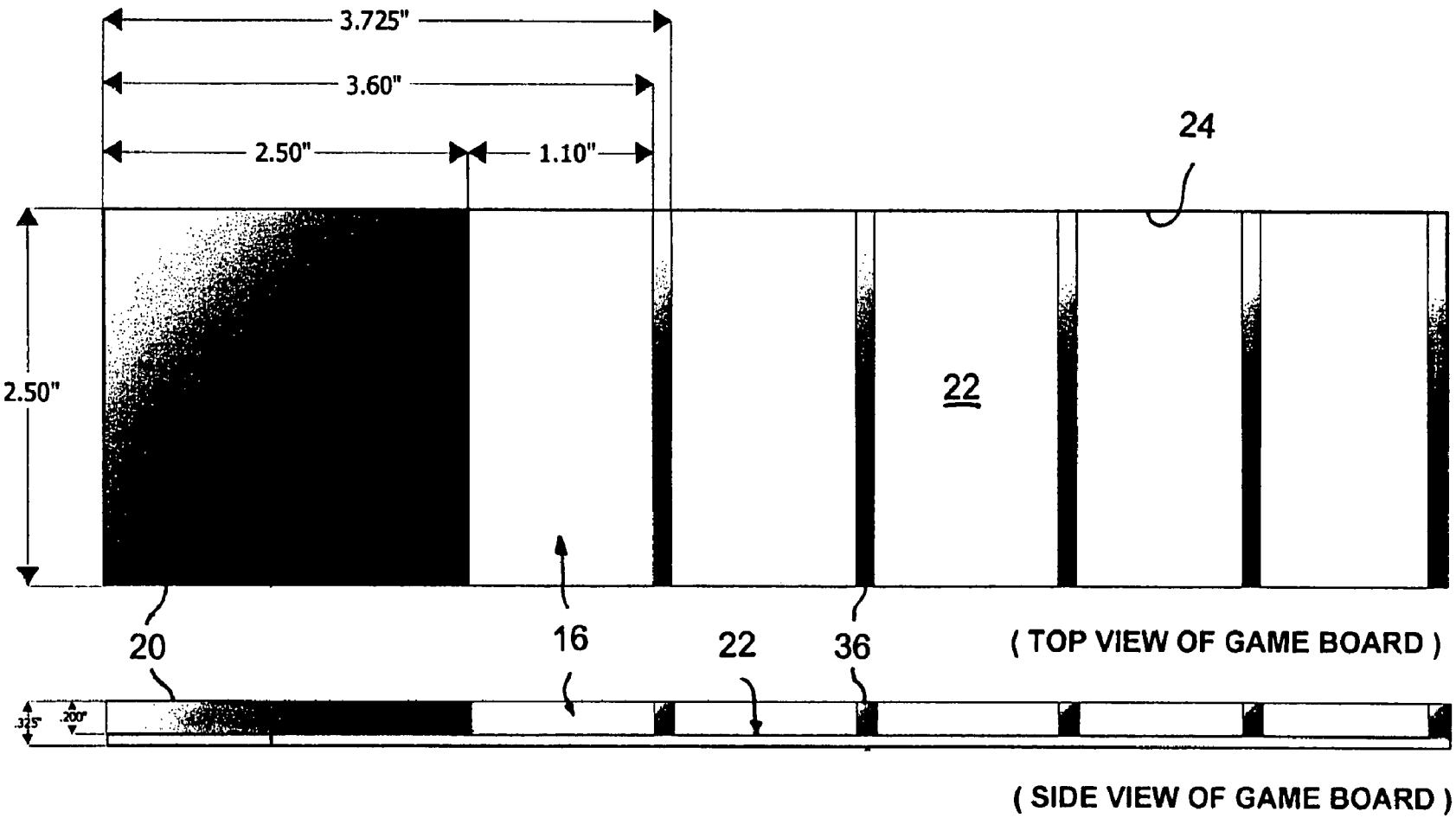
FIG. 5 is a detailed view (top plan and side elevation) showing the placement and sizing of apertures.

Referring now in detail to FIGS. 1, 2 and 5, the peripheral edges 14, part of the base members 52 in this embodiment, contain a plurality of apertures 16. The apertures 16 are positioned along all sides of the game board 10, and are sized to enable insertion of tiles 18, as explained fully below, being generally elongate and rectangular in shape. The apertures 16 are separated and defined by walls 36, the apertures 16 being open upwardly against the upper surface member 12 and outwardly of the peripheral edges 14. The game board 10 is also provided with four corners 20, which are sealed but would be provided with surface indicia related to game play.

Figure 9:
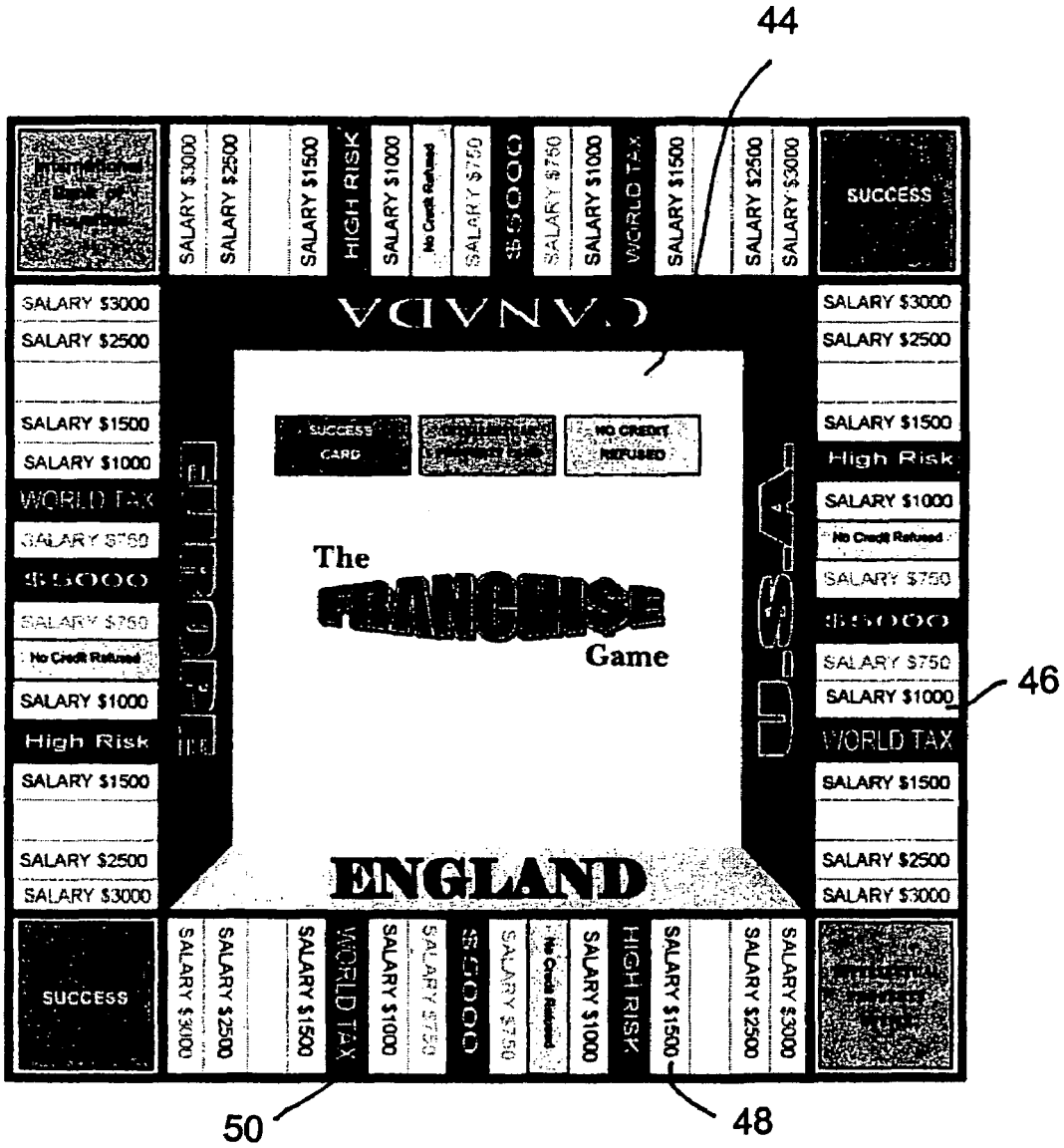
FIG. 9 is a top plan view of sample game indicia for use with a game board according to the present invention.

Referring now in detail to FIGS. 1, 3 and 5, the apertures 16 comprise a lower surface 22 and an inner end surface 24. Due to the transparency of the upper surface member 12, the lower surface 22 can be observed therethrough. The lower surface 22 would be provided with aperture indicia 46, providing symbols or words relevant to game play, as can be seen in FIG. 9 (where sample surface indicia 44 such as the "Intellectual Property Card" indicia, and aperture indicia 46 such as the "Salary $1500" indicia, are displayed). The inner end surface 24 of each aperture 16 acts as a stop to limit further insertion of a tile 18, ensuring that a tile protuberance 26 will extend beyond the peripheral edge 14 as explained more fully below.

Figure 6:
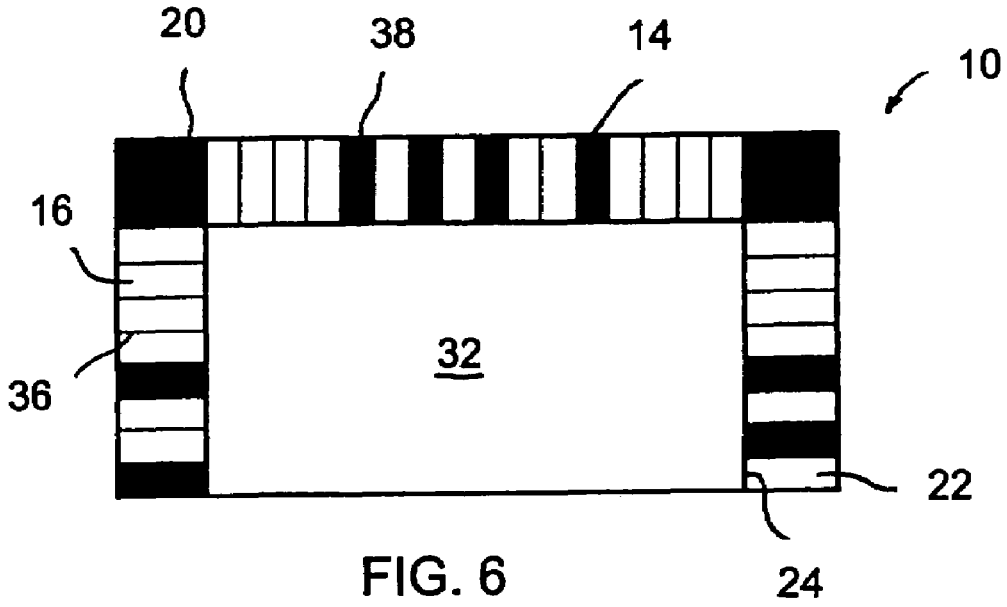
FIG. 6 is a top plan view showing open and blocked apertures.

In addition to the provision of open apertures 16 about the periphery of the game board 10, for insertion of tiles 18, there can also be a number of sealed apertures 38, as can be seen in FIG. 6. Sealed apertures 38 would be provided where the game concept requires certain aperture indicia 46 to always be observable, whereas insertion of a tile 18 would otherwise cover such aperture indicia 46. The utility of such sealed apertures 38 will be explained more fully below, and it is to be noted that the sealed apertures 38 may be selectively sealable, where it is desired to provide a generic game board 10 for use with a variety of selected game concepts. In the exemplary embodiment illustrated in FIG. 6, each of the first and second parts 32, 34 are provided with two corners 20, twenty-four open apertures 16, and eight sealed apertures 38, as determined by the particular game concept.

Figure 7:
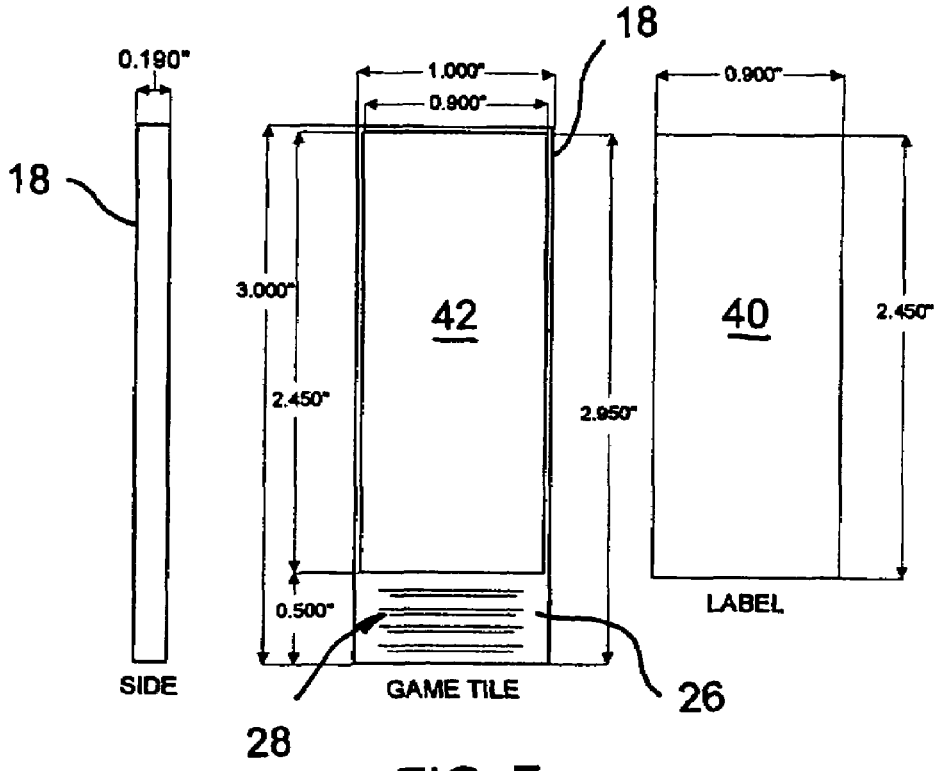
FIG. 7 is an enlarged view of a tile (side, top, and label sizing)
Figure 8:
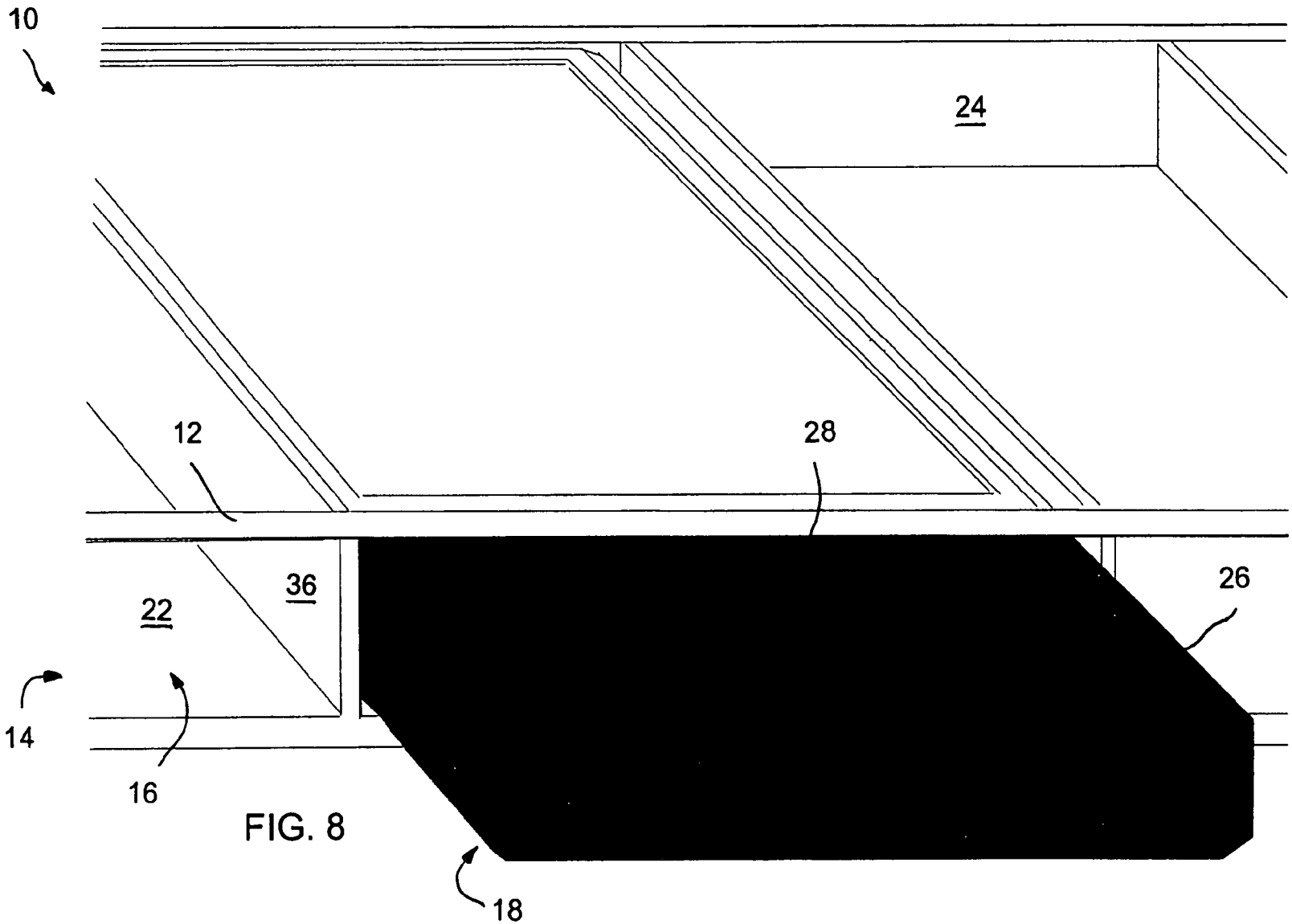
FIG. 8 is an enlarged perspective view of a tile inserted within an aperture.

As indicated above, the apertures 16 are provided for enabling insertion of tiles 18 around the peripheral edges 14 of the game board 10. As can best be seen in FIGS. 7 and 8, each tile 18 is sized to be received within an aperture 16, such that the tile protuberance 26 extends beyond the peripheral edge 14 to enable grasping by a player and removal of the tile 18 from the aperture 16. Tile 18 removal is assisted by the provision of ridges 28 on the tile protuberance 26 for gripping. The tiles 18 are generally elongate and rectangular in form, and can also have bevelled edges as shown in FIG. 8. As can be seen in FIG. 7, each tile 18 is provided with a tile face 42, to which a tile label 40 may be affixed; such a tile label 40 would present tile indicia (not shown) relevant to game play. The tile face 42 may be recessed to protect the edges of the tile label 40.

The utility of the present invention becomes clear in the following situation, wherein is described game play for two players utilizing the game board 10. According to the exemplary embodiment, a game board 10 as described above is provided with surface indicia 44, aperture indicia 46, and tile indicia on the tile labels 40, setting out symbols or words relevant to game play as controlled by the given rules of the particular game. FIG. 9 illustrates surface indicia 44 and aperture indicia 46 (the latter observable through the transparent upper surface member 12) that could be employed with a game board 10 according to the present invention, the game concept being one of franchise business acquisition. The surface indicia 44 include spaces for placement of player tokens (not shown), game cards (not shown), and game currency (not shown), and a die or dice (not shown) are used to determine movement of the player tokens across the game board 10. Each of the apertures 16 are disposed beneath the spaces for placement of player tokens, each aperture 16 including a lower surface 22 provided with the aperture indicia 46.

Although the rules of the particular game will govern the game play to an extent, the novel structure of the game board 10 is employed as follows. On a game board 10 having surface indicia 44 and aperture indicia 46 as shown in FIG. 9, players will each place a player token at a selected starting position on the upper surface member 12; in the exemplary embodiment, the player tokens may be placed on either of the "Success" spaces, located at corners 20, and the player tokens will move around the game board 10 in a clockwise direction based on dice rolls. The players then take turns rolling the die or dice to determine the number of spaces by which their player token may be advanced, in a manner well known in the art. Landing on certain spaces may require or enable certain actions, such as drawing a game card or obtaining game currency, again in a manner well known in the art.

Certain spaces 48 will be provided where the underlying aperture 16 is open and available for insertion of a tile 18, while other spaces 50 will be located above sealed apertures 38. This positioning of spaces 48, 50 will be based on whether the game concept indicates that an aperture indicia 46 should always be available for influencing game play (e.g. landing on a "High Risk" indicia), requiring a sealed aperture 38, or that the aperture indicia 46 should be able to be covered (and hence superseded) by indicia on an inserted tile 18 (e.g. effectively eliminating a "Salary $1500" indicia when a player is able to insert a tile 18 having franchise indicia on it, such that any other player would be forced to pay the "franchisee" player an amount of game currency rather than collect "salary"). As tiles 18 are removable, the rules of the game may indicate that a player could, for example, obtain the right to insert a tile 18 into whichever aperture 16 they chose, thereby affecting game play, and later during game play give up the tile 18; in this manner, aperture indicia 46 may be alternatively covered and revealed as dictated by the rules of play. For example, a player using the game board 10 for the franchise game concept (as illustrated in FIG. 9) may acquire game currency through landing on a plurality of "salary" spaces; once enough game currency is accumulated, the player may "purchase" franchise rights with the game currency, the franchise rights represented by a tile 18, and the tile 18 may then be inserted into any open and available aperture 16.

In addition to the rules of play, the surface indicia 44, aperture indicia 46, and tile indicia on tile labels 40 will provide additional game instructions, guiding game play and enhancing the enjoyment and challenge for the players.

As mentioned above, it is possible to manufacture the entire game board 10 out of transparent plastic, not only the upper surface member 10. In that case, it is possible to have two game concepts on a single board. For example, the indicia of the franchise game concept of FIG. 9 could be presented on one surface of the game board 10, while indicia for a different game concept could be presented on the opposite surface. Tiles 18 could also then be provided with indicia on opposed sides, relevant to the two game concepts.

While a particular embodiment of the present invention has been described in the foregoing, it is to be understood that other embodiments are possible within the scope of the invention and are intended to be included herein. It will be dear to any person skilled in the art that modifications of and adjustments to this invention, not shown, are possible without departing from the spirit of the invention as demonstrated through the exemplary embodiment. For example, if the upper surface member was not composed of transparent plastic, tile indicia could be provided on the tile protuberance itself to enable observation. Other such examples will be dear from the foregoing. The invention is therefore to be considered limited solely by the scope of the appended claims.

Embodiments of the invention in which an exclusive property or privilege is claimed are defined as follows:

1. A method of playing a board game, for at least two players, the board game comprising:

a generally transparent upper surface member, provided with surface indicia relevant to game play, the surface indicia including spaces for placement of player tokens;

a peripheral edge connected to the upper surface member;

at least one aperture in the peripheral edge for receiving a tile member, the at least one aperture disposed beneath the spaces for placement of player tokens, the at least one aperture including a lower surface provided with aperture indicia relevant to game play and open to the upper surface member to enable observation of the aperture indicia;

at least one tile member for selective insertion within the at least one aperture, the at least one tile member provided with tile indicia relevant to game play;

at least two player tokens for movement across the upper surface member; and at least one die for determining an amount of movement for each of the at least two player tokens across the upper surface member;

the method comprising the steps of:

a. placing the at least two player tokens at a selected location on the surface indicia;

b. allowing the at least two players to alternate rolling the at least one die to determine the amount of movement for each of the at least two player tokens across the upper surface member;

c. moving each of the at least two player tokens by thusly determined amounts of movement;

d. when moving one of the at least two player tokens to a space above an aperture, observing the aperture indicia, the aperture indicia providing game instruction;

e. responding to the game instruction provided by the aperture indicia; and f. in the event that the aperture is empty, allowing the player to insert a tile member into the aperture, covering the aperture indicia and allowing observation of the tile indicia, which tile indicia provides game instruction.

* * * * *